US009354000B2

(12) United States Patent
Wang et al.

(10) Patent No.: US 9,354,000 B2
(45) Date of Patent: May 31, 2016

(54) HEAT EXCHANGE DEVICE

(75) Inventors: Feng Wang, Zhejiang (CN); Jianlong Jiang, Zhejiang (CN); Xiaohui Wu, Zhejiang (CN); Qiang Gao, Zhejiang (CN); Linjie Huang, East Amherst, NY (US)

(73) Assignees: SANHUA (HANGZHOU) MICRO CHANNEL HEAT EXCHANGE CO., LTD., Hangzhou, Zhejiang Province (CN); DANFOSS A/S, Nordborg (DK)

( * ) Notice: Subject to any disclaimer, the term of this patent is extended or adjusted under 35 U.S.C. 154(b) by 671 days.

(21) Appl. No.: 13/463,066

(22) Filed: May 3, 2012

(65) Prior Publication Data

US 2012/0279689 A1 Nov. 8, 2012

(30) Foreign Application Priority Data

May 6, 2011 (CN) ..... 2011 1 0117006

(51) Int. Cl.

| | |
|---|---|
| ***F28F 13/06*** | (2006.01) |
| ***F24F 13/08*** | (2006.01) |
| ***F28D 1/04*** | (2006.01) |
| *F28B 1/06* | (2006.01) |
| *F28F 17/00* | (2006.01) |
| *F28F 9/22* | (2006.01) |

(52) U.S. Cl.

CPC ..... *F28F 13/06* (2013.01); *F24F 13/08* (2013.01); *F28D 1/0426* (2013.01); *F28B 1/06* (2013.01); *F28F 17/005* (2013.01); *F28F 2009/222* (2013.01)

(58) Field of Classification Search

CPC ..... F24F 13/30
USPC ..... 165/124; 62/285
See application file for complete search history.

(56) References Cited

U.S. PATENT DOCUMENTS 1,227,770 A * 5/1917 Fleischmann ..... 165/149
3,752,226 A * 8/1973 Bullock ..... 165/59

(Continued)

FOREIGN PATENT DOCUMENTS

CN 1523317 A 1/2004
CN 1672006 A 9/2005

(Continued)

OTHER PUBLICATIONS

Aug. 10, 2012 European Search Report for EP 12 16 6884.

*Primary Examiner* — Allen Flanigan
(74) *Attorney, Agent, or Firm* — Howard & Howard Attorneys PLLC

(57) ABSTRACT

A heat-exchange device comprises a first heat exchanger defining an upper end and a lower end. A second heat exchanger defines an upper end connected to the upper end of the first heat exchanger and a lower end spaced apart from the lower end of the first heat exchanger in a substantially longitudinal direction such that a predetermined angle between the first heat exchanger and second heat exchanger is between about 0 and 180°. A wind-guide member is disposed between the first heat exchanger and second heat exchanger for guiding wind toward the first heat exchanger and second heat exchanger.

13 Claims, 11 Drawing Sheets

(56) References Cited

U.S. PATENT DOCUMENTS

| | | | | |
|---|---|---|---|---|
| 3,831,670 | A | 8/1974 | Mullings | |
| 4,000,779 | A | 1/1977 | Irwin | |
| 4,458,665 | A | 7/1984 | Vandervaart | |
| 4,691,766 | A * | 9/1987 | Wurz et al. | 165/135 |
| 6,874,345 | B2 | 4/2005 | Stoynoff, Jr. | |
| 7,793,514 | B2 * | 9/2010 | Rios et al. | 62/285 |
| 7,882,708 | B2 | 2/2011 | Richter et al. | |

FOREIGN PATENT DOCUMENTS

| | | | |
|---|---|---|---|
| CN | 1782601 | | 6/2006 |
| CN | 101694360 | A | 4/2010 |
| CN | 101738126 | A | 6/2010 |
| CN | 102012186 | A | 4/2011 |
| DE | 3515441 | A1 | 10/1986 |
| DE | 4219642 | C1 | 10/1993 |
| GB | 1488842 | | 10/1977 |
| JP | 200555013 | A | 3/2005 |

* cited by examiner

HEAT EXCHANGE DEVICE

CROSS-REFERENCE TO RELATED APPLICATION

This application claims priority to and benefit of the filing date of Chinese Patent Application 201110117006.3 filed on May 6, 2011 and entitled "Heat-exchange device," which is hereby incorporated by reference in its entirety.

BACKGROUND OF INVENTION

1. Field of Invention

The invention relates to, in general, refrigeration and, more particularly, a heat-exchange device.

2. Description of Related Art

A heat-exchange device may be used in wide application—for example, an air conditioner. A conventional heat-exchange device is generally flat-plate shaped. However, in some applications, the heat-exchange device needs to be bent to divide the heat-exchange device into a first heat-exchanger portion and a second heat-exchanger portion between which a predetermined angle is formed. In use, the heat-exchange device is placed in a box, and wind flows upward from a lower surface of the heat-exchange device and exchanges heat with a refrigerant in the heat-exchange tubes when passing through the first and second heat-exchanger portions.

The heat-exchange performance is an important parameter of the heat-exchange device, and, consequently, improving the heat-exchange performance is an important research direction of the heat-exchange device. Thus, there is a need in the related art for a heat-exchange device having improved heat-exchange performance.

SUMMARY OF INVENTION

The invention overcomes disadvantages in the related art in a heat-exchange device comprising a first heat exchanger defining an upper end and a lower end. A second heat exchanger defines an upper end connected to the upper end of the first heat exchanger and a lower end spaced apart from the lower end of the first heat exchanger in a substantially longitudinal direction such that a predetermined angle between the first heat exchanger and second heat exchanger is between about 0 and 180°. A wind-guide member is disposed between the first heat exchanger and second heat exchanger for guiding wind toward the first heat exchanger and second heat exchanger For a bent heat-exchange device, a distribution uniformity of wind speed across a surface of the heat-exchange device has significant influence on the heat-exchange performance of the heat-exchange device. For example, the heat-exchange device is disposed in a box, air flows from the bottom to the top, and the wind speed is not distributed uniformly across an entire surface of the heat-exchange device, which may influence the heat-exchange performance. In an embodiment, a bottom portion of the heat-exchange device is closer to the box such that the influence of the box on the wind is larger, the wind-resistance is large, and the wind speed is low. But, an upper portion of the heat-exchange device is farther from the box such that the influence of the box on the wind is smaller, the wind resistance is small, and the wind speed is high. As a result, the heat-exchange performance of the heat-exchange device is influenced. Therefore, the performance of the heat-exchange device may be improved by improving the distribution uniformity of the wind speed. Accordingly, the heat-exchange device of the invention improves the distribution uniformity of the wind speed to improve the heat-exchange performance.

With the substantially inverted V-shaped heat-exchange device according to embodiments of the invention, the wind-guide member may guide the wind toward the first and second heat exchangers, which may improve the distribution uniformity of the wind speed across the surface of the heat-exchange device to improve the performance of the heat-exchange device.

In some embodiments, the lower end of the first heat exchanger is aligned with the lower end of the second heat exchanger, a height of each of the first and second heat exchangers in a vertical direction is "H," a distance from the lowest point of the wind-guide member to the lowest point of each of the first and second heat exchangers in the vertical direction is "H1," and $0 \leq H1/H \leq 4/5$.

In some embodiments, the wind-guide member is a V-shaped wind-guide plate.

In some embodiments, an upper edge of a first side wall of the wind-guide plate is connected to an upper portion of the first heat exchanger, and an upper edge of a second side wall of the wind-guide plate is connected to an upper portion of the second heat exchanger.

In some embodiments, in a horizontal plane passing through the wind-guide plate, a distance between the first and second side walls of the wind-guide plate is "L2," a distance between the first side wall of the wind-guide plate and the first heat exchanger is "L1," a distance between the second side wall of the wind-guide plate and the second heat exchanger is "L3," $L2/(L1+L2+L3)=1$ in a horizontal plane passing through a top edge of the wind-guide plate, and $0 \leq L2/(L1+L2+L3) \leq 0.95$ in horizontal planes passing through other parts of the wind-guide plate than the top edge of the wind-guide plate.

In some embodiments, a water-guide groove is formed at one outer side of a bottom portion of the wind-guide plate.

In some embodiments, the first and second side walls of the wind-guide plate are in the shape of arcs protruding toward each other.

In some embodiments, the heat-exchange device comprises further a first side plate mounted on one side of the first and second heat exchangers in a transversal direction and a second side plate mounted on the other side of the first and second heat exchangers in the transversal direction in which two ends of the wind-guide member in the transversal direction are connected to the first and second side plates, respectively.

In some embodiments, the wind-guide member is a V-shaped wind-guide plate, an upper edge of a first side wall of the wind-guide plate is spaced apart from the upper end of the first heat exchanger by a predetermined distance, and an upper edge of a second side wall of the wind-guide plate is spaced apart from the upper end of the second heat exchanger by a predetermined distance.

In some embodiments, in any horizontal plane passing through the wind-guide plate, a distance between the first and second side walls of the wind-guide plate is "L2," a distance between the first side wall of the wind-guide plate and the first heat exchanger is "L1," a distance between the second side wall of the wind-guide plate and the second heat exchanger is "L3," and $5 \leq L2/(L1+L2+L3) \leq 0.95$.

In some embodiments, the wind-guide member is an olivary wind-guide plate or a tube having a circular or diamond cross-section.

In some embodiments, the wind-guide member includes a plurality of wind-guide plates divided into a first group and second group. The first group is spaced apart from the second group in a transversal direction, and the wind-guide plates in each group are spaced apart from each other in a vertical direction.

In some embodiments, each wind-guide plate is a flat plate or an arcuate plate, and the wind-guide plates of the first group are in one-to-one correspondence with the wind-guide plates of the second group.

In some embodiments, the wind-guide member includes a plurality of wind-guide plates spaced apart from each other in a vertical direction and having shapes different from each other.

In some embodiments, the first and second heat exchangers are formed by bending a single flat-plate heat exchanger or by two separate flat-plate heat exchangers connected with each other.

Other objects, features, and advantages of the invention are readily appreciated as the same becomes better understood while the subsequent detailed description of embodiments of the invention is read taken in conjunction with the accompanying drawing thereof.

BRIEF DESCRIPTION OF EACH FIGURE OF DRAWING OF INVENTION

DETAILED DESCRIPTION OF EMBODIMENTS OF INVENTION

Figure 21:
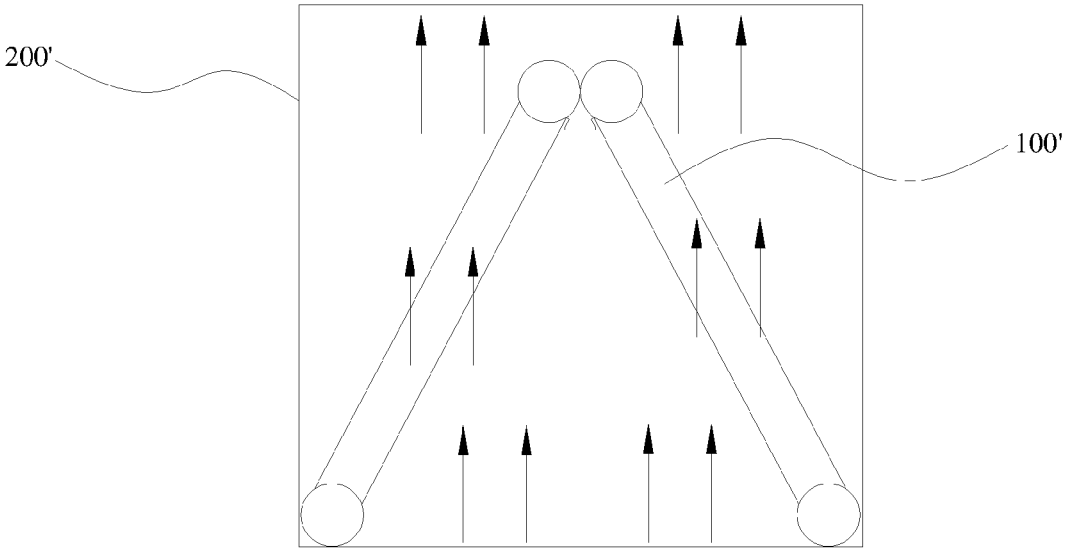
FIG. 21 is a front view of a conventional heat-exchange device placed in a box.

Distribution uniformity of wind speed across a surface of a heat-exchange device has significant influence on the heat-exchange performance of the heat-exchange device. FIG. 21 is a front view of a conventional heat-exchange device 100' placed in a box 200'. As shown in FIG. 21, the conventional heat-exchange device 100' has a substantially inverted V-shape, and wind blows from the bottom toward the top. The wind speed at a top portion of the conventional heat-exchange device 100' is over-high, and there is a "dead region" at a lower portion of the conventional heat-exchange device 100'. In the "dead region," the wind speed is low, and the heat-exchange efficiency is poor. Therefore, the wind speed is not distributed uniformly across a surface of the conventional heat-exchange device, which may disadvantageously influence the heat-exchange performance.

Figure 1:
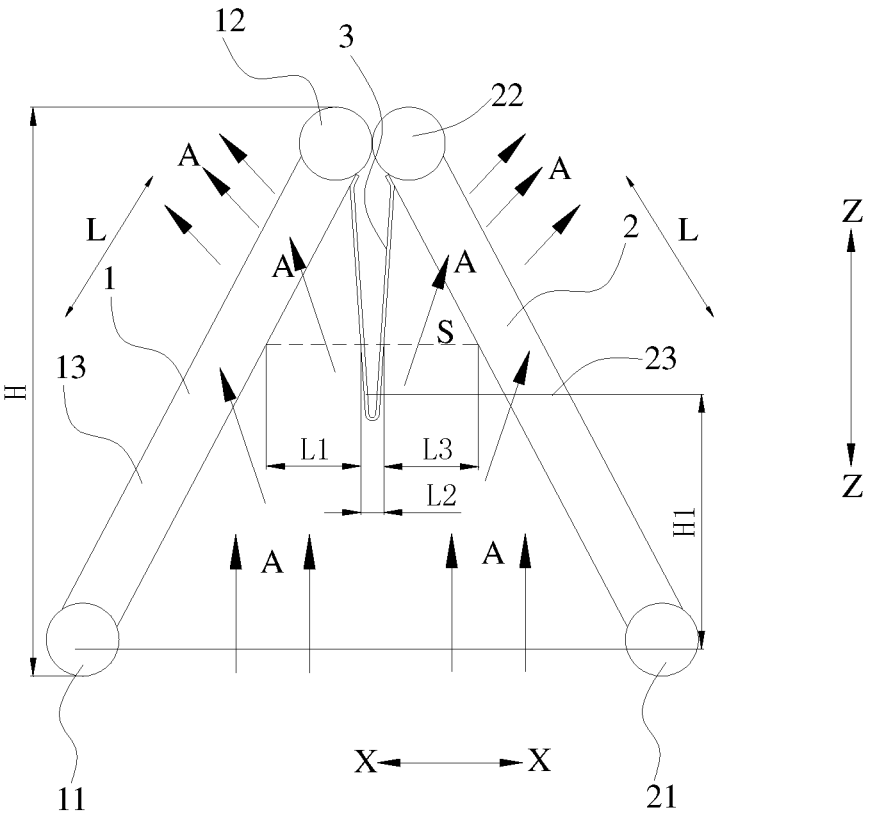
FIG. 1 is a front view of a heat-exchange device according to an embodiment of the invention.
Figure 1A:
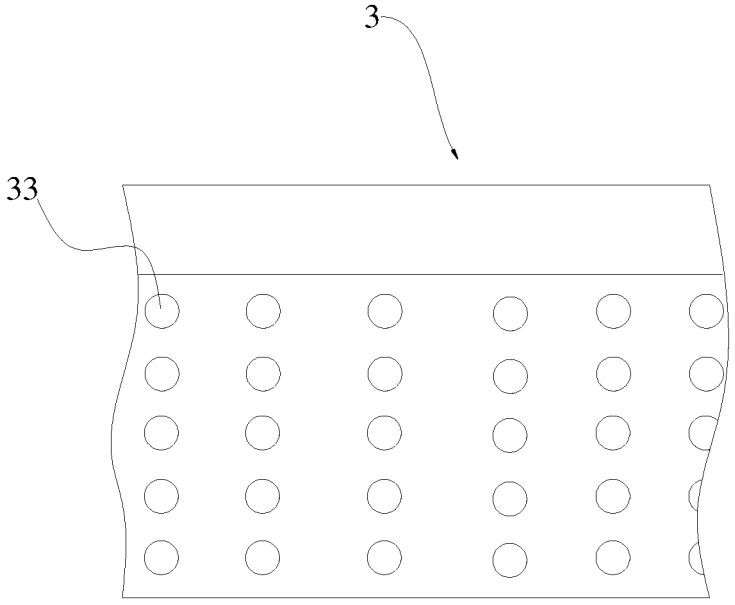
FIG. 1A is a plan view of a representative first and second side wall of the wind-guide plate illustrating a predetermined quantity of holes extending therethrough.

As shown in FIG. 1, a heat-exchange device according to embodiments of the invention comprises a first heat exchanger 1, a second heat exchanger 2, and a wind-guide member 3. The first heat exchanger 1 defines an upper end and a lower end. The second heat exchanger 2 defines an upper end connected to the upper end of the first heat exchanger 1 and a lower end spaced apart from the lower end of the first heat exchanger 1 in a longitudinal direction "X" (i.e., the left and right directions in FIG. 1) such that a predetermined angle "θ" between the first heat exchanger 1 and second heat exchanger 2 is formed, where $0<\theta<180°$. Therefore, the first heat exchanger 1 and second heat exchanger 2 form a substantially inverted V-shaped heat-exchange device such that an inner surface (i.e., a right surface of the first heat exchanger 1 in FIG. 1) of the first heat exchanger 1 is opposite to an inner surface (i.e., a left surface of the second heat exchanger 2 in FIG. 1) of the second heat exchanger 2.

That the upper end of the second heat exchanger 2 is connected to the upper end of the first heat exchanger 1 should be construed in a broad sense. For example, the upper end of the second heat exchanger 2 may be contacted with the upper end of the first heat exchanger 1, the upper end of the second heat exchanger 2 may be spaced apart from the upper end of the first heat exchanger 1 by a very small distance, or the upper end of the second heat exchanger 2 may be connected to the upper end of the first heat exchanger 1 directly or indirectly via a connecting member (as long as the first heat exchanger 1 and second heat exchanger 2 may form a substantially inverted V-shaped heat-exchange device).

The wind-guide member 3 is disposed between the first heat exchanger 1 and second heat exchanger 2 for guiding wind toward the first heat exchanger 1 and second heat exchanger 2. In an embodiment, the wind-guide member 3 is disposed between the inner surface of the first heat exchanger 1 and the inner surface of the second heat exchanger 2.

As shown in FIG. 1, in use, when the heat-exchange device is orientated in a vertical direction "Z" (that is, an opening of the heat-exchange device faces downwardly), the wind blows from the bottom upwardly, and the wind-guide member 3 guides the wind toward the first heat exchanger 1 and second heat exchanger 2, thus improving a distribution uniformity of the wind speed across the surface of each of the first and second heat exchangers 1, 2. In other words, the wind speed across the surface of each of the first and second heat exchangers 1, 2 along a "length" direction "L" of each of the first and second heat exchangers 1, 2 is uniform, thus improving the heat-exchange efficiency of the heat-exchange device.

Figure 2:
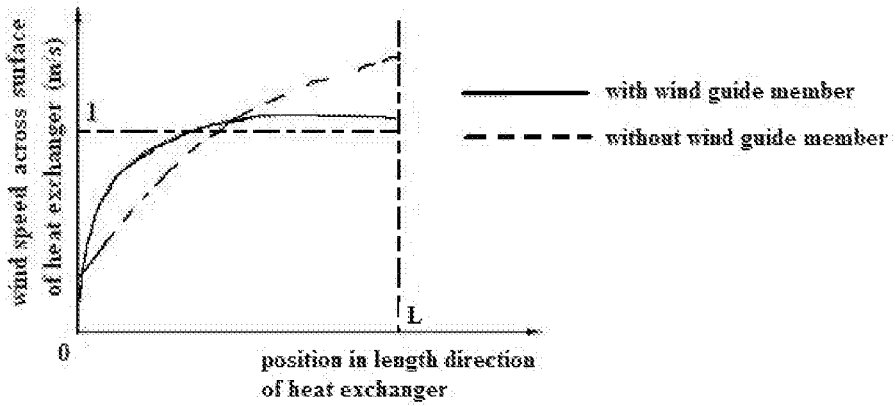
FIG. 2 shows a "curve" diagram of wind speed across a surface of a heat-exchange device according to an embodiment of the invention and a "curve" diagram of wind speed across a surface of a conventional heat-exchange device.

In FIG. 2, the solid line shows a "curve" diagram of the wind speed in the "length" direction "L" of each of the first and second heat exchangers 1, 2, and the dashed line shows a "curve" diagram of wind speed in a "length" direction of a conventional heat-exchange device. It may be seen from FIG. 2 that, with embodiments of the heat-exchange device, by adding the wind-guide member 3, the wind is guided toward the first heat exchanger 1 and second heat exchanger 2 by the wind-guide member 3, thus changing the distribution uniformity of the wind speed. Therefore, a "dead region" in a lower portion of the heat-exchange device is decreased, and the wind speed across the surface of each of the first and second heat exchangers 1, 2 along the "length" direction "L" of each of the first and second heat exchangers 1, 2 is distributed uniformly, thus improving the heat-exchange performance of the heat-exchange device.

In some embodiments, the lower end of the first heat exchanger 1 is aligned with the lower end of the second heat exchanger 2. For example, the first heat exchanger 1 may be axi-symmetric to the second heat exchanger 2. A height of each of the first and second heat exchangers 1, 2 in the vertical direction "Z" is "H," a distance from the lowest point of the wind-guide member 3 to the lowest point of each of the first and second heat exchangers 1, 2 in the vertical direction is "H1," and, in an embodiment, $0 \leq H1/H \leq 4/5$. When $0 \leq H1/H \leq 4/5$, the wind speed may be distributed more uniformly to further improve the heat-exchange performance.

As shown in FIG. 1, in some embodiments, the wind-guide member 3 is substantially a V-shaped wind-guide plate. An upper edge of a first side wall (i.e., a left side wall in FIG. 1) of the wind-guide plate 3 is connected to an upper portion of the first heat exchanger 1, and an upper edge of a second side wall (i.e., a right side wall in FIG. 1) of the wind-guide plate 3 is connected to an upper portion of the second heat exchanger 2. In other words, the upper edge of the left side wall of the wind-guide plate 3 is connected to a portion of the inner surface of the first heat exchanger 1 adjacent to the upper end of the first heat exchanger 1, and the upper edge of the right side wall of the wind-guide plate 3 is connected to a portion of the inner surface of the second heat exchanger 2 adjacent to the upper end of the second heat exchanger 2.

In an embodiment, a predetermined quantity of through-holes may be formed in the first and second side walls of the wind-guide plate 3 to adjust the distribution uniformity of the wind speed across the surface of the heat-exchange device.

As shown in FIG. 1, in a horizontal plane "S" passing through the wind-guide plate 3, a distance between the first and second side walls of the wind-guide plate 3 is "L2," a distance between the first side wall of the wind-guide plate 3 and the inner surface of the first heat exchanger 1 is "L1," and a distance between the second side wall of the wind-guide plate 3 and the inner surface of the second heat exchanger 2 is "L3." In an embodiment, in a horizontal plane "S" passing through a top edge of the wind-guide plate 3, $L2/(L1+L2+L3)=1$ (that is, $L1=L3=0$). In horizontal planes "S" passing through other parts of the wind-guide plate 3 than the top edge of the wind-guide plate 3, $0-L2/(L1+L2+L3) \leq 0.95$. By setting $L2/(L1+L2+L3)$ in the above range, the distribution uniformity of the wind speed across the surface of each of the first and second heat exchangers 1, 2 may be further improved, thus improving the heat-exchange performance.

As shown in FIG. 1, the first heat exchanger 1 and second heat exchanger 2 may be two separate heat exchangers connected with each other. The first heat exchanger 1 and second heat exchanger 2 may be flat-plate heat exchangers. For example, the first heat exchanger 1 includes a first header 11, second header 12, plurality of first heat-exchange tubes 13, and plurality of first fins (not shown in FIG. 1). Each first heat-exchange tube 13 may be, for example, a flat tube, the first heat-exchange tubes 13 are disposed parallel to each other between the first header 11 and second header 12, and two ends of each first heat-exchange tube 13 are connected to the first and second headers 11, 12, respectively, to communicate the first and second headers 11, 12. The first fins are interposed between adjacent first heat-exchange tubes 13.

Similarly, the second heat exchanger 2 includes a third header 21, fourth header 22, plurality of second heat-exchange tubes 23, and plurality of second fins (not shown in FIG. 1). Each second heat-exchange tube 23 may be, for example, a flat tube, the second heat-exchange tubes 23 are disposed parallel to each other between the third header 21 and fourth header 22, and two ends of each second heat-exchange tube 23 are connected to the third and fourth headers 21, 22, respectively, to communicate the third and fourth headers 21, 22. The second fins are interposed between adjacent second heat-exchange tubes 23. The second header 12 of the first heat exchanger 1 is contacted with the fourth header 22 of the second heat exchanger 2.

Figure 7:
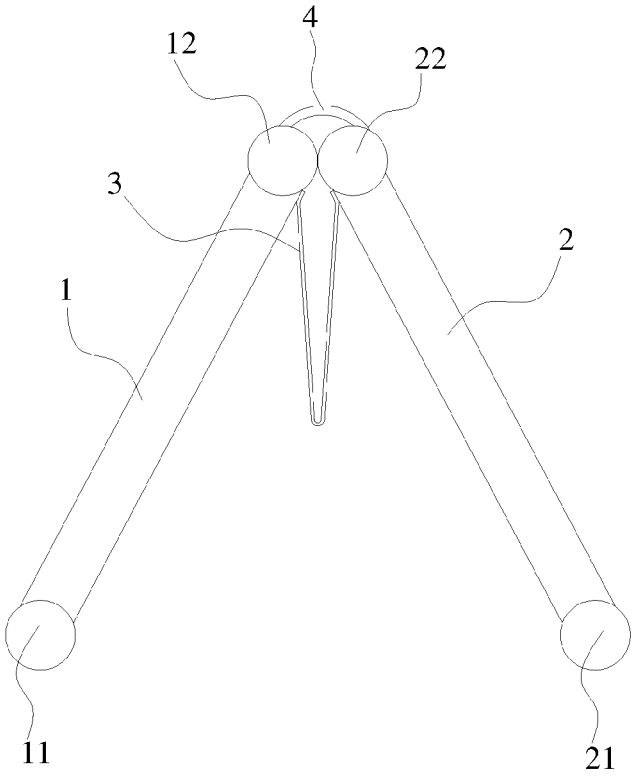
FIG. 7 is a front view of a heat-exchange device according to another embodiment of the invention.

Alternatively, as shown in FIG. 7, in another embodiment, the second header 12 of the first heat exchanger 1 is communicated with the fourth header 22 of the second heat exchanger 2 via a communicating pipe 4 such that the first heat exchanger 1 is connected with the second heat exchanger 2 in series.

Figure 8:
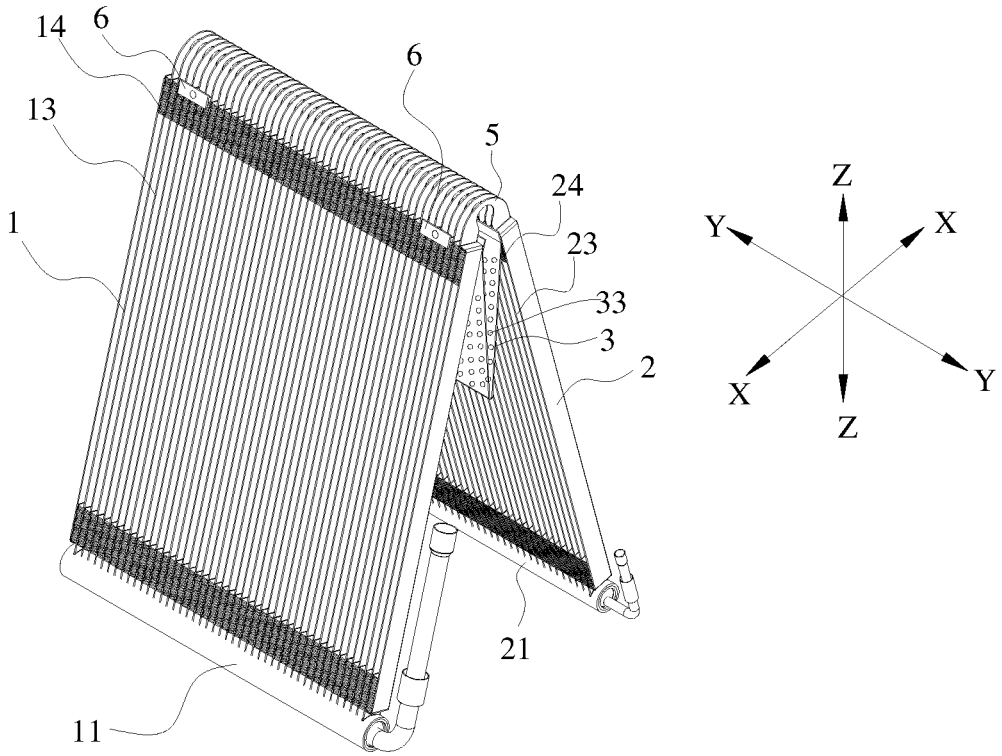
FIG. 8 is a perspective view of a heat-exchange device according to another embodiment of the invention.
Figure 9:
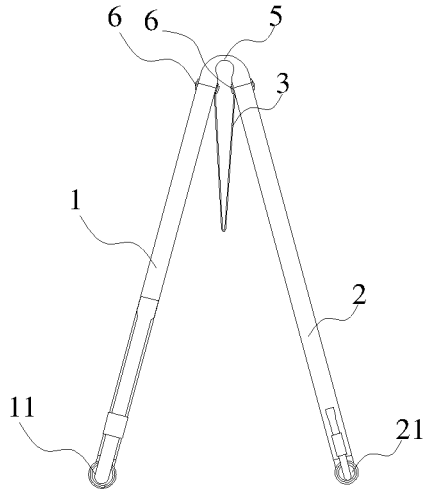
FIG. 9 is a front view of the embodiment of the heat-exchange device of the invention shown in FIG. 8.
Figure 10:
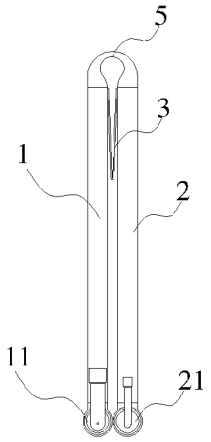
FIG. 10 shows a state of the embodiment of the heat-exchange device of the invention shown in FIG. 8 when it is transported.

In some embodiments, the heat-exchange device may be formed by bending a single flat-plate heat exchanger. In other words, the first heat exchanger 1 and second heat exchanger 2 may be two portions formed by bending a single flat-plate heat exchanger. As shown in FIGS. 8-10, the heat-exchange device comprises the first header 11 and third header 21, a plurality of heat-exchange tubes are disposed between the first header 11 and third header 21, a plurality of fins are interposed between adjacent heat-exchange tubes, and each heat-exchange tube is bent at a predetermined position to divide the heat-exchange device into the first heat exchanger 1 and second heat exchanger 2. Therefore, each heat-exchange tube is divided into a first heat-exchange-tube portion 13 and second heat-exchange-tube portion 23, and each fin is divided into a first fin portion 14 and second fin portion 24. To facilitate bending, at a bent portion 5, no fins are interposed between adjacent heat-exchange tubes. In the embodiment shown in FIG. 8, the first heat exchanger 1 is connected with the second heat exchanger 2 in series. With embodiments of the heat-exchange device, the first heat exchanger 1 and second heat exchanger 2 are formed by bending a single flat-plate heat exchanger. FIG. 8 is a perspective view of a heat-exchange device according to another embodiment, FIG. 9 is a front view of the heat-exchange device according to this embodiment, and FIG. 10 shows a "folded" state of the heat-exchange device according to this embodiment when it is transported. The heat-exchange device according to this embodiment may be folded when it is transported, thus saving space and facilitating the transportation.

Figure 11:
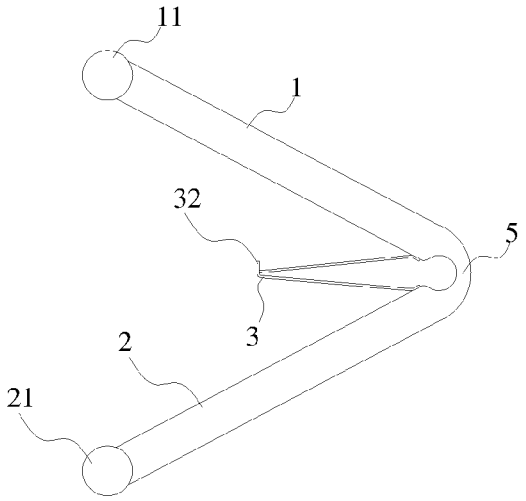
FIG. 11 shows a state of the embodiment of the heat-exchange device of the invention shown in FIG. 8 when it is used horizontally.
Figure 12:
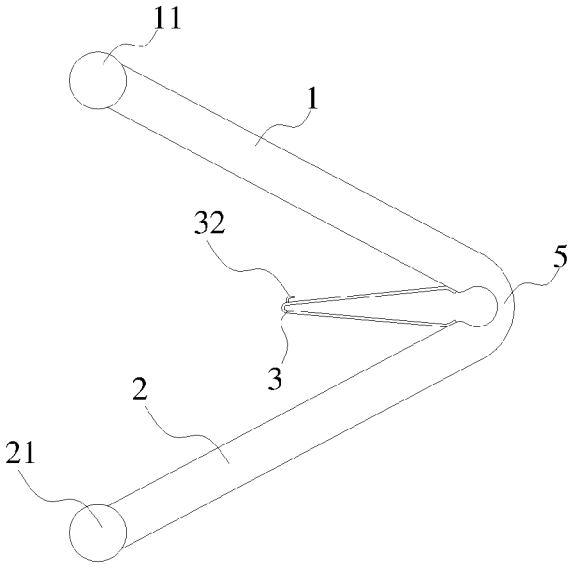
FIG. 12 shows another state of the embodiment of the heat-exchange device of the invention shown in FIG. 8 when it is used horizontally.

It should be appreciated by those having ordinary skill in the related art that there is no limitation that embodiments of the heat-exchange device be orientated in the vertical direction "Z." As shown in FIGS. 11-12, embodiments of the heat-exchange device may be orientated in the horizontal direction (that is, the opening of heat-exchange device is orientated in the horizontal direction). For example, in FIGS. 11-12, the wind blows from left to right in the horizontal direction, and the wind-guide plate 3 may guide the wind toward the first heat exchanger 1 and second heat exchanger 2, which may improve the distribution uniformity of the wind speed across the surface of the heat-exchange device to improve the heat-exchange performance.

As shown in FIGS. 8-9, in the embodiment, the upper edge of the first side wall of the wind-guide plate 3 is mounted onto the upper portion of the first heat exchanger 1 through fastening plates 6, which are disposed on inner and outer sides of the first heat exchanger 1 and connected with each other via bolts. Similarly, the upper edge of the second side wall of the wind-guide plate 3 is mounted on the upper portion of the second heat exchanger 2 through block plates 6, which are disposed on inner and outer sides of the second heat exchanger 2 and connected with each other via bolts.

When embodiments of the heat-exchange device are used as an evaporator, the condensed water is generated on the surface of the heat-exchange device. If the wind-guide plate 3 is contacted with the surface of the heat-exchange device, the condensed water is also generated on a surface of and drop along the wind-guide plate 3. As shown in FIGS. 11-12, when embodiments of the heat-exchange device are orientated in the horizontal direction and used as an evaporator, to prevent the condensed water generated on the first heat exchanger 1 from dropping through the wind-guide plate 3 directly, a water-guide groove is formed at one outer side of a bottom portion (a left end portion in FIGS. 11-12) of the wind-guide plate 3 for guiding flow of the condensed water.

As shown in FIG. 11, the wind-guide plate 3 is formed by two separate side plates (i.e., an upper side plate and a lower side plate) in which a left end of the lower side plate is bent to form an extending portion 32 extended upward. That is, the lower side plate is substantially L-shaped. A left end of the upper side plate is connected with the extending portion 32 of the lower side plate to form the water-guide groove.

As shown in FIG. 12, alternatively, the V-shaped wind-guide plate 3 may be integrally formed. An extending portion 32 is disposed on the upper portion of the left end of the V-shaped wind-guide plate 3, and the water-guide groove is defined by the extending portion 32 and V-shaped wind-guide plate 3.

Figure 3:
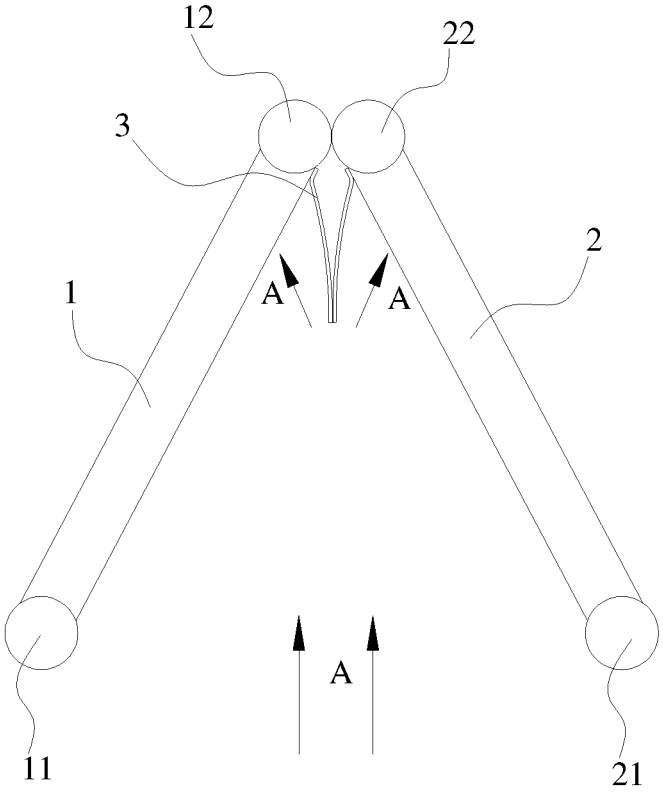
FIG. 3 is a front view of a heat-exchange device according to another embodiment of the invention.
Figure 4:
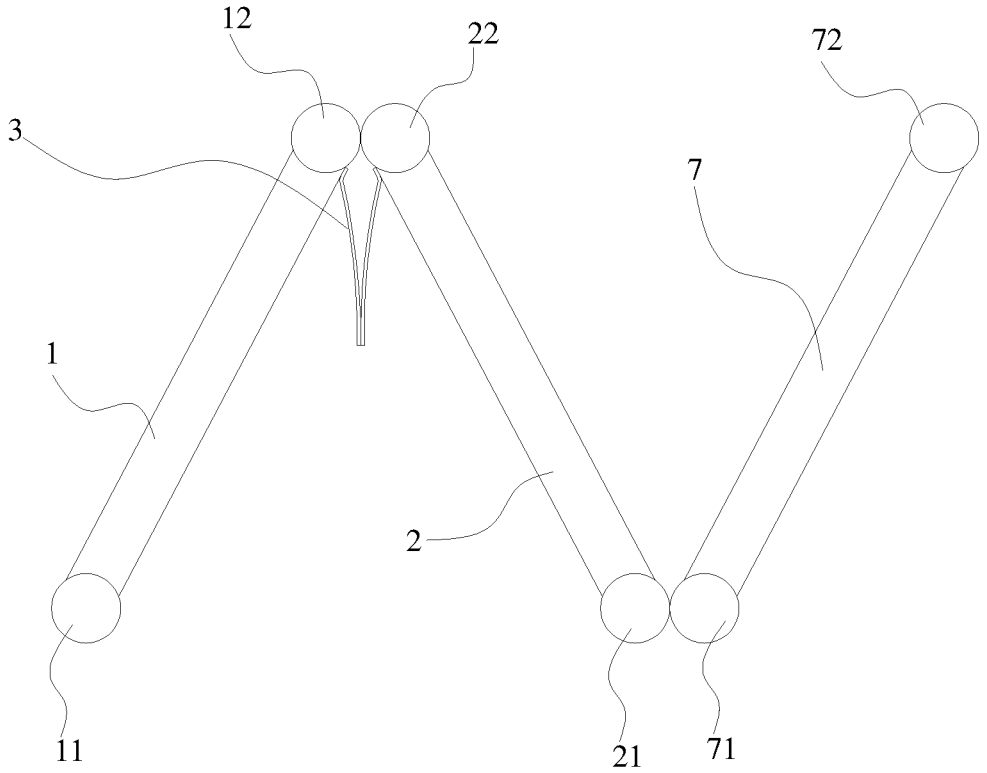
FIG. 4 is a front view of a heat-exchange device according to another embodiment of the invention.

FIG. 3 shows a heat-exchange device according to another embodiment in which the wind-guide member 3 is a V-shaped wind-guide plate, and the first and second side walls of the wind-guide plate 3 are in the shape of arcs protruding toward each other. FIG. 4 shows a heat-exchange device according to another embodiment in which the shape of the wind-guide member 3 is the same as that of the wind-guide member 3 in FIG. 3. The heat-exchange device in the embodiment shown in FIG. 4 comprises further a third heat exchanger 7. The third heat exchanger 7 includes, for example, two headers 71, 72, a plurality of heat-exchange tubes are connected between the two headers 71, 72, and fins are interposed between adjacent heat-exchange tubes. In other words, the structure of the third heat exchanger 7 may be the same as that of each of the first heat exchanger 1 and second heat exchanger 2, the header 71 is adjacent to the third header 21 of the second heat exchanger 2, and a predetermined angle is formed between the third heat exchanger 7 and second heat exchanger 2 such that the heat-exchange device shown in FIG. 4 is substantially N-shaped. It should be appreciated by those having ordinary skill in the related art that embodiments of the heat-exchange device may be, for example, substantially W- or M-shaped.

Figure 5:
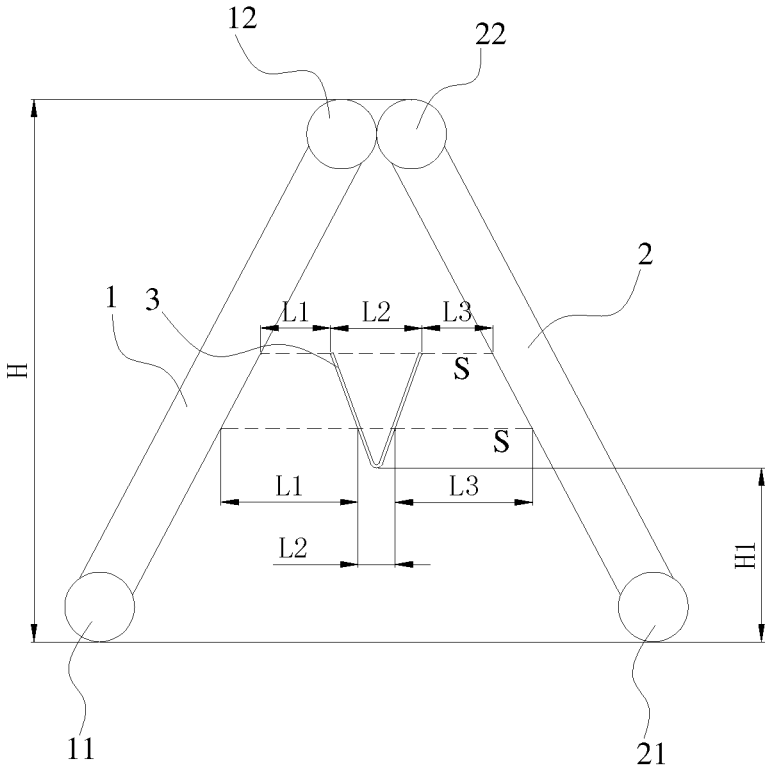
FIG. 5 is a front view of a heat-exchange device according to another embodiment of the invention.

As shown in FIG. 5, in some embodiments, the heat-exchange device comprises further a first side plate (not shown) mounted on one side of the first and second heat exchangers 1, 2 in a transversal direction "Y" and a second side plate (not shown) mounted on the other side of the first and second heat exchangers 1, 2 in the transversal direction "Y." In other words, the first heat exchanger 1, second heat exchanger 2, first side plate, and second side plate define a substantially inverted V-shaped space, and two ends of the wind-guide member 3 in the transversal direction "Y" are connected to the first and second side plates, respectively, such that the wind-guide member 3 is located in the substantially inverted V-shaped space.

As shown in FIG. 5, the wind-guide member 3 is a V-shaped wind-guide plate, and the upper edge of the first side wall of the wind-guide plate 3 is spaced apart from the upper end of the first heat exchanger 1 by a predetermined distance, and the upper edge of the second side wall of the wind-guide plate 3 is spaced apart from the upper end of the second heat exchanger 2 by a predetermined distance. In any horizontal plane passing through the wind-guide plate 3, a distance between the first and second side walls of the wind-guide plate 3 is "L2," a distance between the first side wall of the wind-guide plate 3 and the first heat exchanger 1 is "L1," a distance between the second side wall of the V-shaped wind-guide plate 3 and the second heat exchanger 2 is "L3," and, in an embodiment, $0 \leq L2/(L1+L2+L3) \leq 0.95$. By setting $L2/(L1+L2+L3)$ in the above range, the distribution uniformity of the wind speed across the surface of the heat-exchange device may be further improved, thus further improving the heat-exchange performance.

In the embodiment shown in FIG. 5, when the shape and size of the wind-guide plate 3 is fixed and "H1" is constant, the distribution uniformity of the wind speed may be optimized by adjusting an angle of the wind-guide plate 3 to improve the heat-exchange performance.

Figure 6:
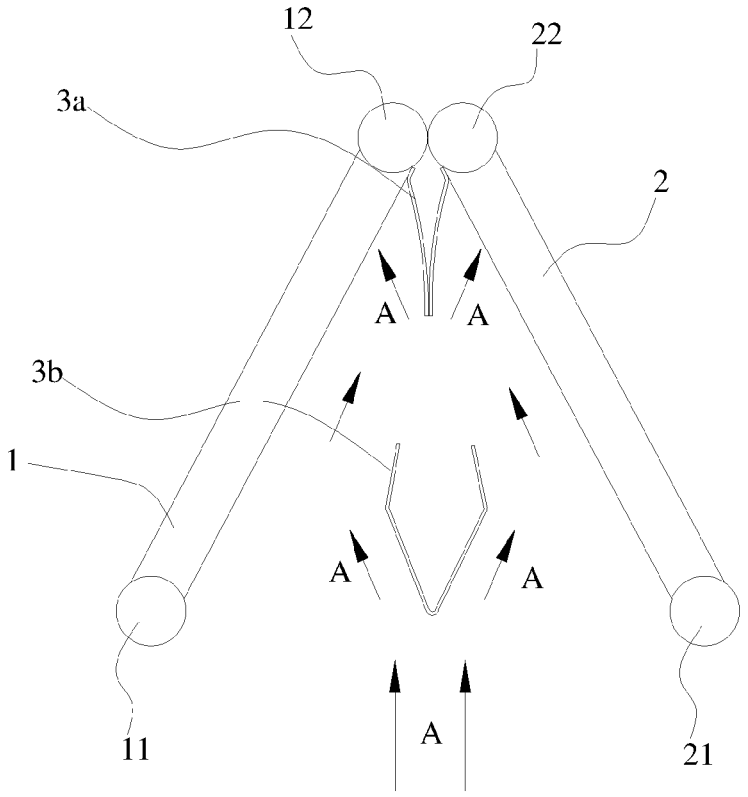
FIG. 6 is a front view of a heat-exchange device according to another embodiment of the invention.
Figure 13:
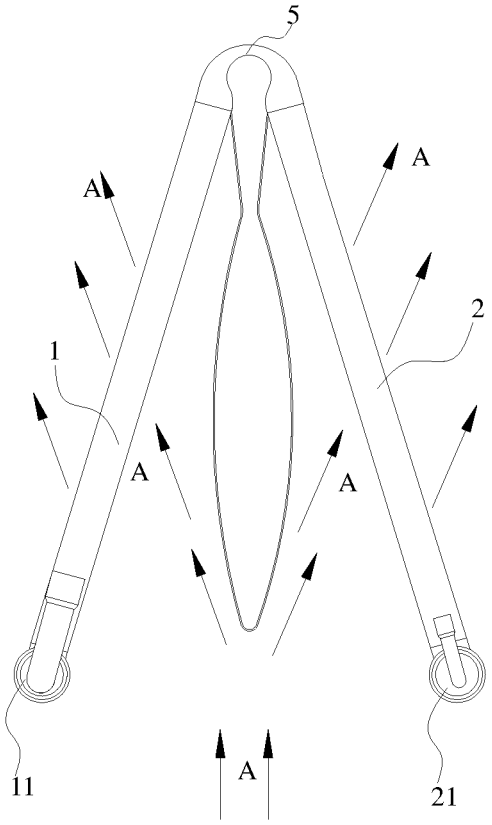
FIG. 13 is a front view of a heat-exchange device according to another embodiment of the invention.
Figure 14:
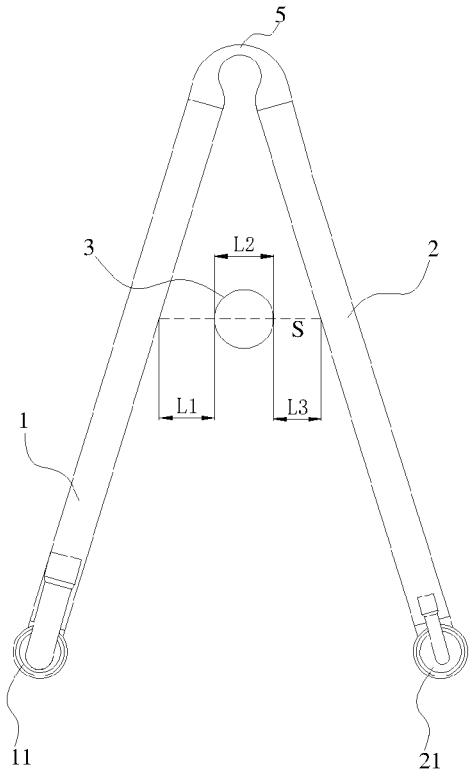
FIG. 14 is a front view of a heat-exchange device according to another embodiment of the invention.
Figure 15:
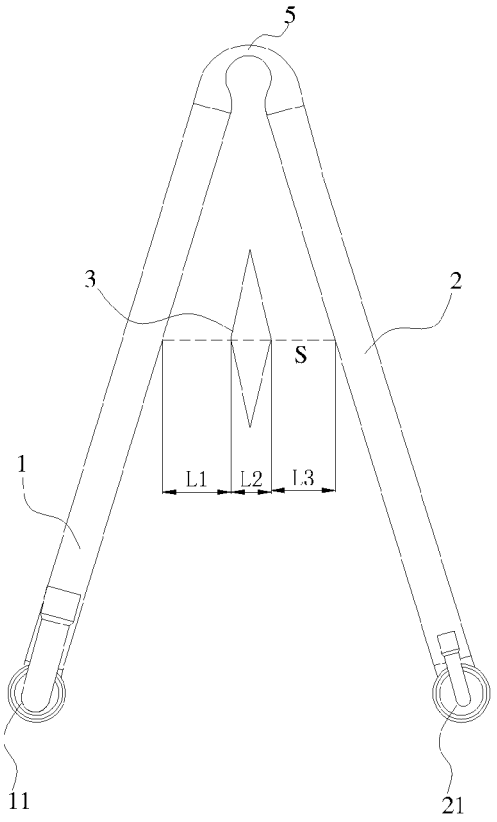
FIG. 15 is a front view of a heat-exchange device according to another embodiment of the invention.
Figure 16:
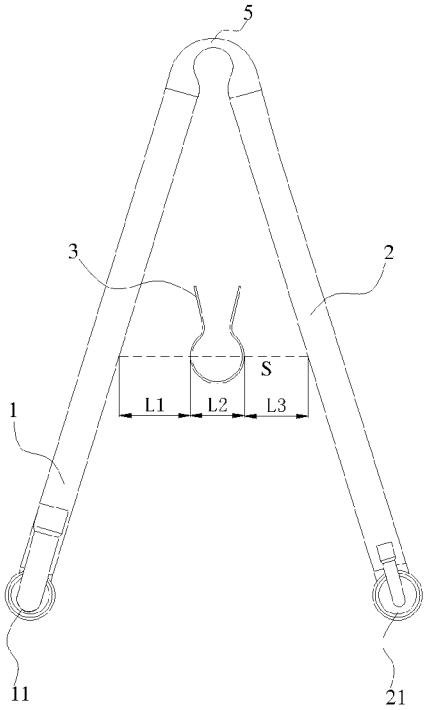
FIG. 16 is a front view of a heat-exchange device according to another embodiment of the invention.

FIG. 6 shows embodiments of a heat-exchange device in which the wind-guide member 3 includes a first V-shaped wind-guide plate 3*a* located in an upper portion of the heat-exchange device and a second V-shaped wind-guide plate 3*b* located in the lower portion of the heat-exchange device. FIGS. 13-16 show other embodiments of the heat-exchange device. In FIG. 13, the wind-guide member 3 is a substantially olivary wind-guide plate. In FIG. 14, the wind-guide member 3 is a tube having a circular cross-section. In FIG. 15, the wind-guide member 3 is a tube having a diamond cross-section. In FIG. 16, the wind-guide member 3 is a circular tube formed with an opening and extending portions on two sides of the opening.

Figure 17:
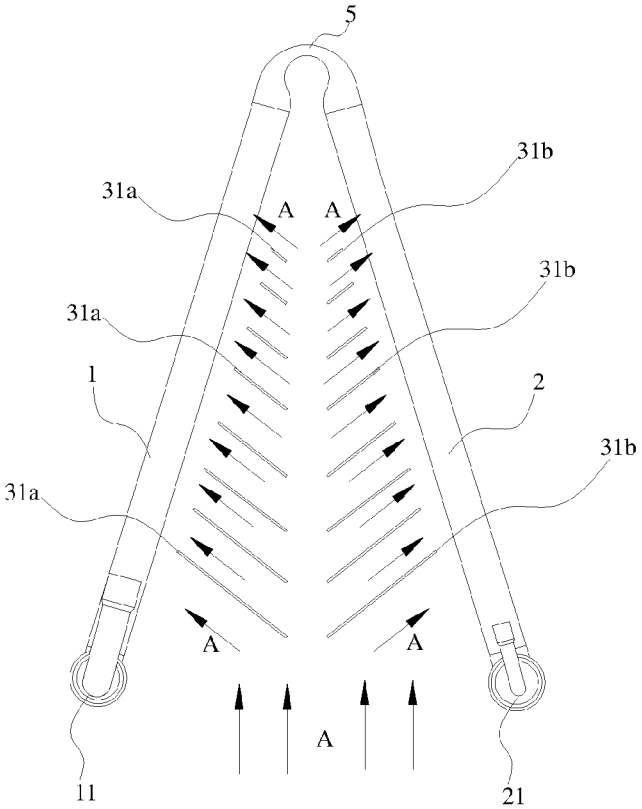
FIG. 17 is a front view of a heat-exchange device according to another embodiment of the invention.
Figure 18:
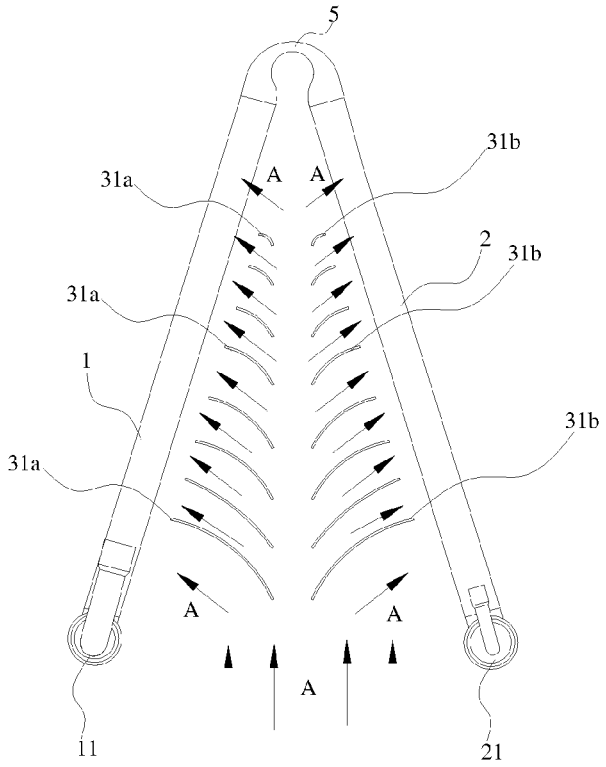
FIG. 18 is a front view of a heat-exchange device according to another embodiment of the invention.
Figure 19:
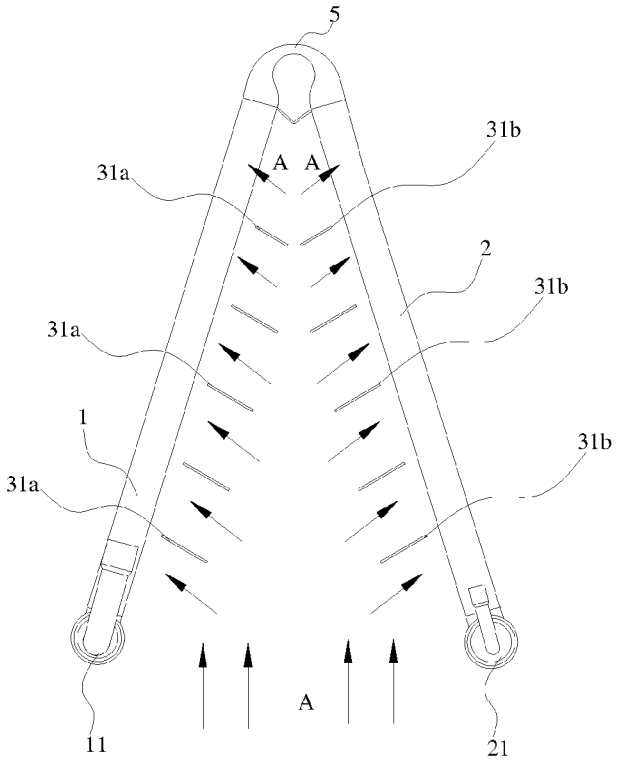
FIG. 19 is a front view of a heat-exchange device according to another embodiment of the invention.
Figure 20:
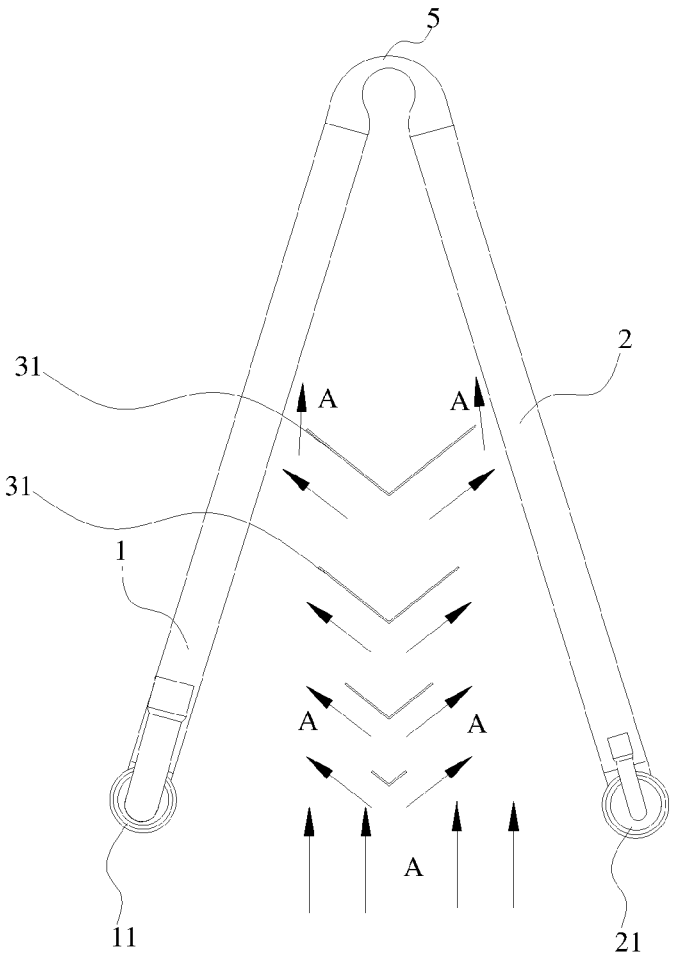
FIG. 20 is a front view of a heat-exchange device according to another embodiment of the invention.

As shown in FIGS. 17-19, in some embodiments, the wind-guide member 3 includes a plurality of wind-guide plates divided into a first group and a second group. The first group is spaced apart from the second group in the transversal direction "Y," and the wind-guide plates in each group are spaced apart from each other in the vertical direction "Z." The first group guides the wind toward the first heat exchanger 1 along the direction "A," and the second group guides the wind toward the second heat exchanger 2 along the direction "A." By dividing the wind-guide member 3 into a plurality of wind-guide plates, the distribution uniformity of the wind speed across the surface of the heat-exchange device may be further improved, thus further improving the heat-exchange performance. Moreover, the guidance for the wind may be conveniently adjusted by adjusting the distance between adjacent wind-guide plates and the angle of each wind-guide plate such that the distribution uniformity of the wind speed across the surface of the heat-exchange device may be further improved.

Each wind-guide plate 31*a* or 31*b* may be a flat plate, as shown in FIG. 17. Alternatively, each wind-guide plate 31*a* or 31*b* may be an arcuate plate, as shown in FIG. 18. As shown in FIGS. 17-18, the wind-guide plates 31*a* of the first group are in one-to-one correspondence with the wind-guide plates 31*b* of the second group. Spaces between the wind-guide plates 31*a*, 31*b* corresponding to each other in the transversal direction "Y" may be increased gradually from the top down, as shown in FIG. 19. In embodiments shown in FIGS. 17-18, spaces between adjacent wind-guide plates in the same group in the vertical direction may be equal to each other. Alternatively, as shown in FIG. 19, spaces between adjacent wind-guide plates in the same group in the vertical direction may not be equal to each other. It should be appreciated by those having ordinary skill in the related art that distances from adjacent wind-guide plates 31*a* in the first group to the inner surface of the first heat exchanger 1 may be identical or different. Similarly, distances from adjacent wind-guide plates 31*b* in the second group to the inner surface of the second heat exchanger 2 may be identical or different.

It should be appreciated by those having ordinary skill in the related art that, with embodiments of the heat-exchange device, the wind-guide member 3 may include a plurality of wind-guide plates spaced apart from each other in the vertical direction "Z" and having shapes different from each other. Therefore, wind-guide plates having suitable shapes may be disposed according to change in the wind speed along the "length" direction of each of the first and second heat exchangers 1, 2, thus achieving the optimization of the distribution uniformity of the wind speed.

In the embodiments, the lowest point of the wind-guide member 3 is higher than the lowest point of each of the first and second heat exchangers 1, 2. Alternatively, the wind-guide member 3 may be extended downward such that the lowest point of the wind-guide member 3 may be lower than the lowest point of each of the first and second heat exchangers 1, 2.

With the embodiments of the heat-exchange device, the wind-guide member 3 is disposed between and may guide the wind toward the first heat exchanger 1 and second heat exchanger 2, which may improve the distribution uniformity of the wind speed across the surface of the heat-exchange device to improve the performance of the heat-exchange device.

The invention has been described above in an illustrative manner. It is to be understood that the terminology that has been used above is intended to be in the nature of words of description rather than of limitation. Many modifications and variations of the invention are possible in light of the above teachings. Therefore, within the scope of the appended claims, the invention may be practiced other than as specifically described above.

What is claimed is:

1. A heat-exchange device comprising:

a first heat exchanger defining an upper end and a lower end;

a second heat exchanger defining an upper end connected to the upper end of the first heat exchanger and a lower end spaced apart from the lower end of the first heat exchanger in a substantially longitudinal direction such that a predetermined angle between the first heat exchanger and second heat exchanger is between about 0 and 180°; and a wind-guide member disposed between the first heat exchanger and second heat exchanger for guiding wind toward the first heat exchanger and second heat exchanger, wherein the wind-guide member is a substantially V-shaped wind-guide plate, wherein an upper edge of a first side wall of the wind-guide plate is connected to an upper portion of the first heat exchanger and an upper edge of a second side wall of the wind-guide plate is connected to an upper portion of the second heat exchanger, and wherein a predetermined quantity of through holes are formed in the first and second side walls of the wind-guide plate.

2. The heat-exchange device according to claim 1, wherein the lower end of the first heat exchanger is substantially aligned with the lower end of the second heat exchanger, a height of each of the first and second heat exchangers in a vertical direction is "H," a distance from a lowest point of the wind-guide member to a lowest point of each of the first and second heat exchangers in the vertical direction is "H1," and $0 \leq H1/H \leq 4/5$.

3. The heat-exchange device according to claim 1, wherein a water-guide groove is formed at an outer side of a bottom portion of the wind-guide plate.

4. The heat-exchange device according to claim 1, wherein the first and second side walls of the wind-guide plate are in substantial shape of arcs protruding toward each other.

5. The heat-exchange device according to claim 1, wherein the device comprises further a first side plate mounted on a side of the first and second heat exchangers in a substantially transversal direction and a second side plate mounted on another side of the first and second heat exchangers in the transversal direction, two ends of the wind-guide member in the transversal direction being connected to the first and second side plates, respectively.

6. The heat-exchange device according to claim 5, wherein the wind-guide member is a substantially V-shaped wind-guide plate, an upper edge of a first side wall of the wind-guide plate is spaced apart from the upper end of the first heat exchanger by a predetermined distance, and an upper edge of a second side wall of the wind-guide plate is spaced apart from the upper end of the second heat exchanger by a predetermined distance.

7. The heat-exchange device according to claim 6, wherein, in any substantially horizontal plane passing through the wind-guide plate, a distance between the first and second side walls of the wind-guide plate is "L2," a distance between the first side wall of the wind-guide plate and the first heat exchanger is "L1," a distance between the second side wall of the wind-guide plate and the second heat exchanger is "L3," and $0 \leq L2/(L1+L2+L3) \leq 0.95$.

8. The heat-exchange device according to claim 1, wherein the wind-guide member is either of an olivary wind-guide plate and a tube defining either of a substantially circular and diamond cross-section.

9. The heat-exchange device according to claim 1, wherein the wind-guide member includes a plurality of wind-guide plates divided into a first group and second group, the first group is spaced apart from the second group in a substantially transversal direction, and the wind-guide plates of each of the groups are spaced apart from each other in a substantially vertical direction.

10. The heat-exchange device according to claim 9, wherein each of the wind-guide plates is either of a substantially flat and arcuate plate and the wind-guide plates of the first group are in substantially one-to-one correspondence with the wind-guide plates of the second group.

11. The heat-exchange device according to claim 1, wherein the wind-guide member includes a plurality of wind-guide plates spaced apart from each other in a substantially vertical direction and having shapes different from each other.

12. The heat-exchange device according to claim 1, wherein the first and second heat exchangers are formed by either of bending a single substantially flat-plate heat exchanger and two separate substantially flat-plate heat exchangers connected with each other.

13. The heat-exchange device according to claim 1, wherein, in a horizontal plane passing through the wind-guide plate, a distance between the first side wall and second side wall of the wind-guide plate is "L2," a distance between the first side wall of the wind-guide plate and the first heat exchanger is "L1," a distance between the second side wall of the wind-guide plate and the second heat exchanger is "L3," $L2/(L1+L2+L3)=1$ in a substantially horizontal plane passing through a top edge of the wind-guide plate, and $0 \leq L2/(L1+L2+L3) \leq 0.95$ in substantially horizontal planes passing through other parts of the wind-guide plate than the top edge of the wind-guide plate.

* * * * *